United States Patent [19]

Graves

[11] Patent Number: 4,979,449

[45] Date of Patent: Dec. 25, 1990

[54] PRESSER FOOT FOR SEWING MACHINES

[76] Inventor: Lynn H. Graves, 605 Bledsoe, NW., Albuquerque, N. Mex. 87107

[21] Appl. No.: 440,279

[22] Filed: Nov. 22, 1989

[51] Int. Cl.[5] ..... D05B 29/08

[52] U.S. Cl. ..... 112/235

[58] Field of Search ..... 112/235, 151, 154, 75, 112/39, 104, 136, 110, 240, 444, 458, 267.2, 446; D15/69, 72, 78

[56] References Cited

U.S. PATENT DOCUMENTS

| | | | |
|---|---|---|---|
| D. 183,390 | 8/1958 | Johnson | D70/2 |
| 282,113 | 7/1883 | Parkhill | |
| 288,529 | 11/1883 | Wellman | |
| 413,325 | 10/1889 | Littlejohn | |
| 907,485 | 12/1908 | Fellows | 112/136 |
| 1,147,960 | 7/1915 | Mathewson | |
| 1,918,643 | 7/1933 | Heck | |
| 2,478,032 | 8/1949 | Wallsh | 112/151 |
| 2,505,402 | 4/1950 | Ingwer | 112/151 X |
| 3,304,896 | 2/1967 | Laidig | 112/235 |
| 4,236,471 | 12/1980 | Okamato et al. | 112/240 |
| 4,583,475 | 4/1986 | Hanyu et al. | 112/235 |

OTHER PUBLICATIONS

Beautiful Sewing the Economical Way by, "White Sewing Machine Co.", date published not known.

*Primary Examiner*—Werner H. Schroeder
*Assistant Examiner*—Sullivan C. Prak
*Attorney, Agent, or Firm*—Deborah A. Peacock; Donovan F. Duggan; Robert W. Weig

[57] ABSTRACT

A presser foot for a sewing machine comprising a bifurcated foot having first and second limbs. the first limb is about twice as wide as the second limb. Selectively spaced indentations are provided on at least one of the limbs to facilitate accurate stitching. The indentations can be on the tops or the sides of the limbs.

15 Claims, 3 Drawing Sheets

PRESSER FOOT FOR SEWING MACHINES

BACKGROUND OF THE INVENTION

1. Field of the Invention (Technical Field):

The invention relates to presser feet and more particularly to a bifurcated presser foot comprising limbs of predetermined width and spaced indentations for facilitating seam allowance estimations.

2. Description of the Related Art

Presser feet for sewing machines are known to practitioners of the sewing arts. Some presser feet, in addition to performing their primary function of pressing downwardly upon the workpiece to facilitate straight and even stitching, have incorporated supplemental features. For example, U.S. Pat. No. 282,113, to Parkhill, entitled *Presser Foot for Sewing Machines;* and U. S. Pat. No. 1,147,960, to Mathewson, entitled *Presser Foot for Sewing Machines,* both generally disclose bearings to reduce frictional contact between presser foot and workpiece.

Other presser feet utilize attachable gauges for aiding in the production of straight and uniform seams and borders. Representations of such attachable gauges are disclosed in U.S. Pat. No. 288,529, to Wellman, entitled *Presser Foot and Gage for Sewing Machines;* U.S. Pat. No. 413,325, to Littlejohn, entitled *Presser Foot and Overlay Guide for Sewing Machines;* and U.S. Pat. No. 1,918,643, to Heck, entitled *Quilter for Sewing Machines.* All of these patents disclose gauges attachable to sewing machine presser feet, ostensibly to facilitate accurate and uniform stitching.

Design as well as utility features have been used. One such design feature is seen in Design Pat. No. 183,390, to Johnson, entitled *Sewing Machine Presser-Foot.*

Nevertheless, a real need exists in the art for a single article which combines the features of presser foot and gauge. The existing gauge devices are cumbersome and somewhat inefficient. They not only require attachment to the presser foot; they require periodic adjustment.

SUMMARY OF THE INVENTION

In accordance with the present invention there is provided a presser foot for sewing machines. This presser foot comprises a bifurcated foot portion. The bifurcated foot portion comprises: a first limb having a first predetermined width dimension; a second limb having a second predetermined width dimension; a plurality of selectively spaced indentations on at least one of the limbs along its longitudinal dimension; a needle aperture and thread slot disposed between the first limb and the second limb; and means for attaching the bifurcated foot portion to a sewing machine.

In the preferred embodiment, the first predetermined width dimension of the first limb is greater than the second predetermined width dimension of the second limb. For example, the first predetermined dimension of the first limb may be essentially about twice as great as the second predetermined dimension of the second limb. In an embodiment for piecing or doll or toy making applications, the first predetermined dimension of the first limb is essentially about ¼", and the second predetermined dimension of the second limb is essentially about ⅛".

In the preferred embodiment, each of the limbs comprises a plurality of spaced indentations; these spaced indentations of both the first limb and the second limb are in matching correspondence. The spaced indentations may be disposed on a longitudinal side of the limb(s), on the top surface of the limb(s) or both. The spaced indentations may be regularly spaced such as ¼" apart. At least one of the spaced indentations should correspond to the center of the needle aperture.

The attachment means for attaching the bifurcated foot portion to the sewing machine comprises an upstanding shank portion adapted to be secured to the sewing machine. The bifurcated foot portion pivots relative to the upstanding shank portion for allowing the foot to move easily over the material being stitched or sewn.

A primary object of the present invention is to provide an improved presser foot especially adapted for piecing and doll and toy making.

Another object of the invention is to provide a presser foot for sewing machines wherein critical seam allowances can be quickly and accurately gauged.

One advantage of the present invention is the combination of presser foot and seam allowance gauge in a single article.

Another advantage of the present invention is the provision of a presser foot having means for conveniently and easily bypassing previous seam allowances.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

Figure 1:
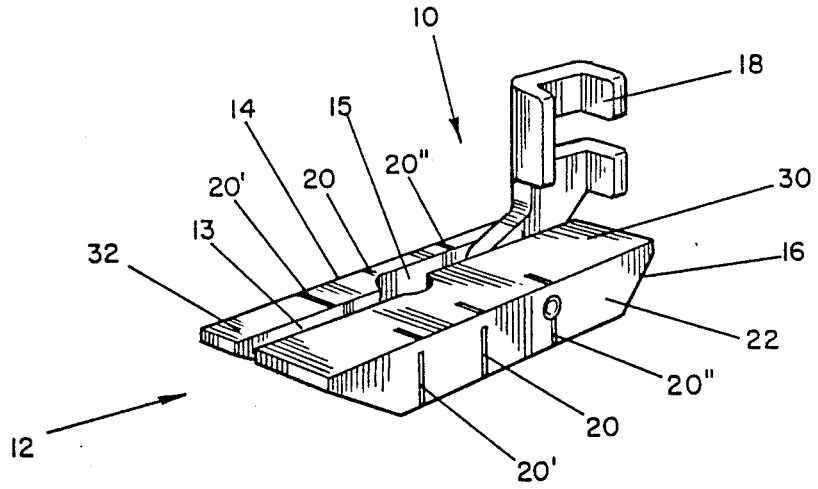
FIG. 1 is a perspective view of the preferred embodiment of the invention.
Figure 2:
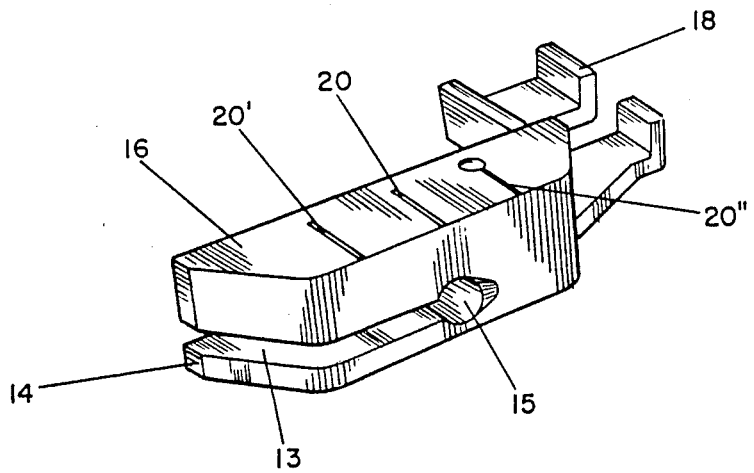
FIG. 2 is a bottom perspective view of the embodiment of FIG. 1.

DETAILED DESCRIPTION OF THE PREFERRED EMBODIMENTS OF THE INVENTION (BEST MODES FOR CARRYING OUT THE INVENTION)

Reference is now made to the FIGS. 1–9 which show the preferred presser foot of the invention. As seen therein, the presser foot 10 comprises a bifurcated foot portion 12 comprising a first toe or limb 16 having a first predetermined width dimension and a second toe or limb 14 having a second predetermined width dimension. Thread slot 13 and needle position or aperture 15 result from the bifurcation. An upstanding shank portion 18 is adapted to be secured in a conventional manner to a sewing machine.

In the preferred embodiment, the first limb 16 is wider than the second limb 14, and most preferably a width which is essentially twice the width of the second limb 14. In the piecing of quilted articles, or toy or doll making, the first limb 16 has a width of ¼" from the center needle position 15 to the outside edge of the first limb 16. This width is useful for gauging the appropriate seam allowance. Likewise, the second limb 14 has a width of ⅛" from the center needle position 15 to the side edge of the second limb 14 so that this narrow limb 16 clears the previous seam allowance makes "easing" easier, prevents "tucks," and provides for better control, even in curved seams. As can be appreciated to those skilled in the art, the limbs 14 and 16 can be of any predetermined widths, depending on the stitching application and the system of measurement (e.g., English or metric systems). As used throughout the specification and claims, the clause "essentially about" concerning the dimension of limbs 14 and 16 is intended to cover the measurement from the needle position to the edges of the limbs 14 and 16.

Figure 10:
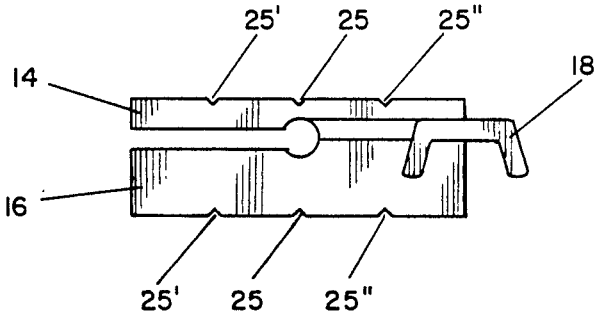
FIG. 10 is a top view of an alternative embodiment of the invention.

In the preferred embodiment, grooves or indentations 20 are regularly spaced longitudinally along outer side or surface 22 of the first limb 16 and top surfaces 30 and 32 of the first limb 16 and second limb 14. However, those skilled in the art will recognize that the indentations need only be on one surface, or may be present on additional surfaces to those shown in the drawings, such as the inside surfaces of the limbs or on the outer surface of limb 14. Similarly, the indentations need not be regularly spaced but could be any selected distance from one another in accordance with a particular contemplated usage for the foot. Likewise, the indentations need not be grooved lines, such as shown in FIGS. 1–9, but could be, for example, V-shaped notches or indentations 25, 25' and 25" (such as shown in FIG. 10), or even U-shaped notches or indentations (not shown) to designate the spaced intervals. The indentations are preferably painted or marked with a coloration distinguishing the indentations from the surrounding portions of the limbs. As can be appreciated by those skilled in the art, markings, such as painted lines or shapes, could also be utilized rather than having a physical groove, notch, or other form of indentation, to designate spaced intervals. The term "indentations", as used throughout the specification and claims, is intended to include all such variations.

In the preferred embodiment, the indentations 20 (also see 25 in FIG. 10) are spaced essentially ¼" from one another. This dimension is particularly important for piecing applications, in starting, stopping, and pivoting a quarter of an inch from the edge of the fabric.

As shown by the drawings, in the preferred embodiment useful for piecing applications, the limbs 14 and 16 comprise three sets of indentations 20 (or notches 25 such as shown in FIG. 10); one set of indentations 20 corresponding to and disposed adjacent the needle hole 15 through which the needle of the sewing machine passes; and the other two sets 20' and 20" spaced evenly (e.g. ¼") from the first set of indentations 20 toward the toe (front) and heel (back) of the limbs respectively. It will be noted that the indentations 20, 20' and 20" on limb 16 match or correspond to indentations 20, 20' and 20" on limb 14 so that the user can easily align material perpendicular to the foot portion 12. This feature is particularly convenient for starting, stopping, or pivoting on a seam.

The foot 10 is not limited to any particular size or shape nor are the spacings of the indentations limited to any particular size or distance therebetween, but can be sized or spaced as appropriate for any stitching application and in any measurement system (e.g., English and metric marking systems). For example, the heel portion of the foot could be elongated to shortened and have various angles, depending on the sewing or stitching application, and depending on the sewing machine (e.g., different "feed dogs"). Likewise, the shank portion need not be as pictured in the drawings, but can be of any size or shape, depending on the sewing or stitching application and the sewing machine. The presser foot 10 may have its own shank portion or may attach to the shank portion of the sewing machine. The invention is intended to cover all such attachment means.

Figure 3:
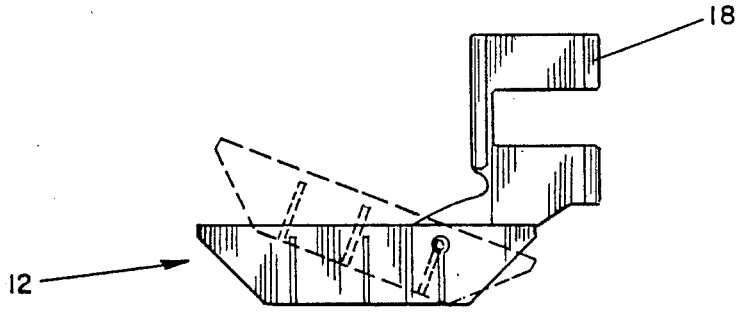
FIG. 3 is a side view of the embodiment of FIG. 1 showing the movement of the presser foot.
Figure 4:
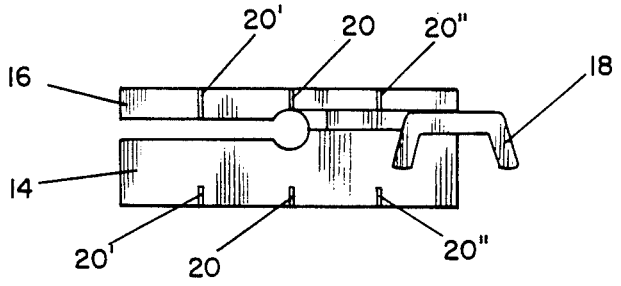
FIG. 4 is a top view of the embodiment of FIG. 1.
Figure 5:
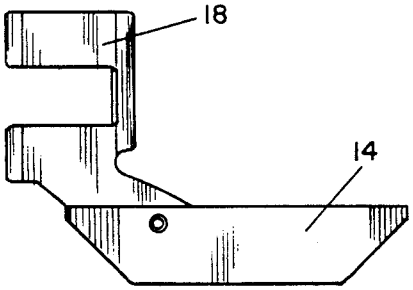
FIG. 5 is one side view of the embodiment of FIG. 1.
Figure 6:
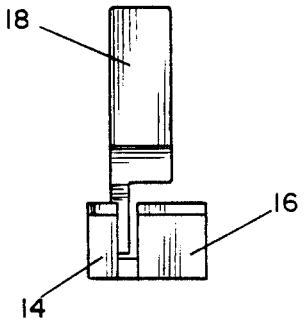
FIG. 6 is a front view of the embodiment of FIG. 1.
Figure 7:
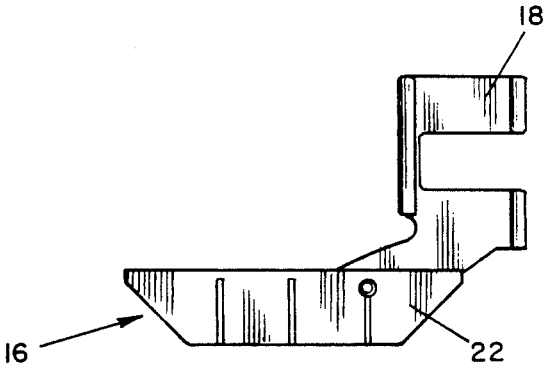
FIG. 7 is another side view of the embodiment of FIG. 1.
Figure 8:
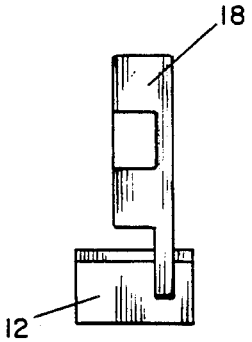
FIG. 8 is a rear view of the embodiment of FIG. 1.
Figure 9:
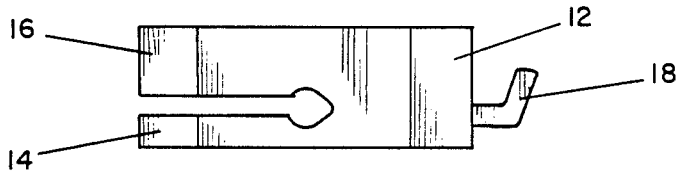
FIG. 9 is a bottom view of the embodiment of FIG. 1.

In operation, when piecing and stitching together a quilt, doll, or toy, for example, indentations 20 (or notches 25) are used to gauge distances from fabric edges or previous seams. This conveniently allows accurate starting, stopping, and pivoting on the stitched seam relative to such edges or previous seams, mitering corners, and setting in angles. FIG. 3 shows pivotal movement of the foot portion 12 to allow ease of movement over materials during stitching or sewing.

Further, seam allowance, which is critical in piecing of a quilted article, can accurately and conveniently be gauged by the predetermined width dimension of limb 16. Conversely, when later bypassing such seams, the narrow width of limb 14 renders such bypassing convenient. The potential barriers posed by previous seams are thus easily overcome.

The invention has been described in detail with particular reference to a preferred embodiment thereof, but it will be understood that variations and modifications can be effected within the scope of the invention.

What is claimed is:

1. A presser foot for sewing machines comprising a bifurcated foot portion, the bifurcated foot portion comprising:

a first limb having a first predetermined width dimension;

a second limb having a second predetermined width dimension, said first predetermined width dimension of said first limb being greater than said second predetermined width dimension of said second limb;

a plurality of selectively spaced indentations on at least one of said limbs along its longitudinal dimension;

a needle aperture and thread slot disposed between said first limb and said second limb; and means for attaching said bifurcated foot portion to a sewing machine.

2. The invention of claim 1 wherein said first predetermined dimension of said first limb is essentially about twice as great as said second predetermined dimension of said second limb.

3. The invention of claim 2 wherein said first predetermined dimension of said first limb is essentially about ¼", and said second predetermined dimension of said second limb is essentially about ⅛".

4. The invention of claim 1 wherein each of said limbs comprises a plurality of spaced indentations.

5. The invention of claim 4 wherein said spaced indentations of both said first limb and said second limb are in matching correspondence.

6. The invention of claim 1 wherein said spaced indentations are disposed on a longitudinal side of at least one said limb.

7. The invention of claim 6 wherein said spaced indentations are disposed on the outside longitudinal side of said limb 8. The invention of claim 7 further comprising spaced indentations on the top surface of said limb, corresponding to said spaced indentations on said outside longitudinal side of said limb.

9. The invention of claim 8 wherein said spaced indentations extend substantially across said top surface and said longitudinal side of said first limb.

10. The invention of claim 1 wherein said spaced indentations are disposed on the top surface of said limb.

11. The invention of claim 1 wherein said spaced indentations are regularly spaced.

12. The invention of claim 1 wherein at least one of said spaced indentations corresponds to the center of said needle aperture.

13. The invention of claim 1 wherein said spaced indentations are essentially ¼" apart.

14. The invention of claim 1 wherein said attachment means comprises an upstanding shank portion adapted to be secured to a sewing machine.

15. The invention of claim 14 wherein said bifurcated foot portion pivots relative to said upstanding shank portion.

* * * * *